United States Patent [19]

Bensette et al.

[11] 4,324,408

[45] Apr. 13, 1982

[54] ICE TO ROLLER SKATE CONVERTER

[76] Inventors: Leonard E. Bensette; Joann Bensette, both of 468 Rosedale Ave., Windsor, Ontario, Canada, N9C 2N4

[21] Appl. No.: 166,710

[22] Filed: Jul. 8, 1980

[51] Int. Cl.[3] ..... A63C 17/18

[52] U.S. Cl. ..... 280/7.13; 280/8; 280/825

[58] Field of Search ..... 280/7.13, 825, 8, 7.12

[56] References Cited

U.S. PATENT DOCUMENTS

| | | | |
|---|---|---|---|
| 250,319 | 11/1881 | Yates | 280/7.13 |
| 992,443 | 5/1911 | Oldfield | 280/7.13 |
| 1,686,667 | 10/1928 | Kaskey | 280/825 |
| 2,155,472 | 4/1939 | Colbert | 280/825 |

*Primary Examiner*—Joseph F. Peters, Jr.
*Assistant Examiner*—Milton L. Smith
*Attorney, Agent, or Firm*—Charles Krassov

[57] ABSTRACT

A device for converting boot-attached ice skates into roller skates and having a casing which fits over the skate, and is buckled to it at about its center by a belt and is attached to the blade at its rear by means of an elasticized band or spring which can be easily attached or released. The casing is equipped with roller skate wheels which rotate upon shafts which are embedded in rubber or any other similar material, to provide resilience to the wheels.

1 Claim, 5 Drawing Figures

ICE TO ROLLER SKATE CONVERTER

This invention relates generally to boot-attached ice and roller skates, and particularly to a device for converting ice skates into roller skates when required.

At the present time, inflated prices being what they are, the price of boot-attached ice and roller skates, is very high, making the purchase price of a pair of such skates, in many cases, prohibitive. It is therefore the object of this invention to provide a device by means of which an ice skate attached to the boot, can be converted into a roller skate, thereby eliminating the cost of another pair of shoes.

This is accomplished in the invention by providing a roller equipped casing which slips over the ice skate, totally enclosing it, and attachable to the skate by rapid and simple attachment and release means.

Figure 1:
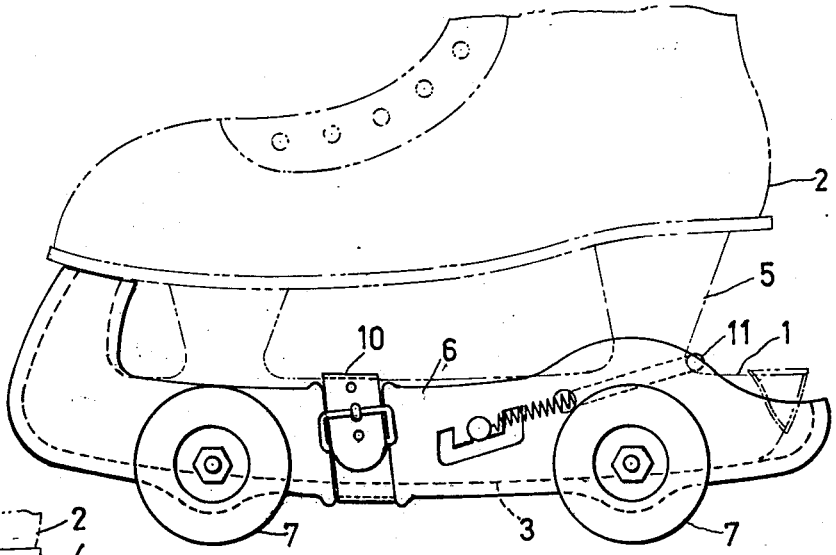
Figure 2:
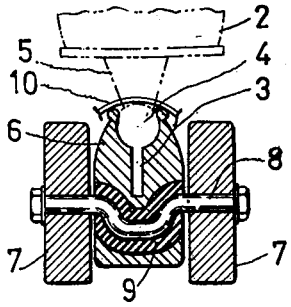
Figure 3:
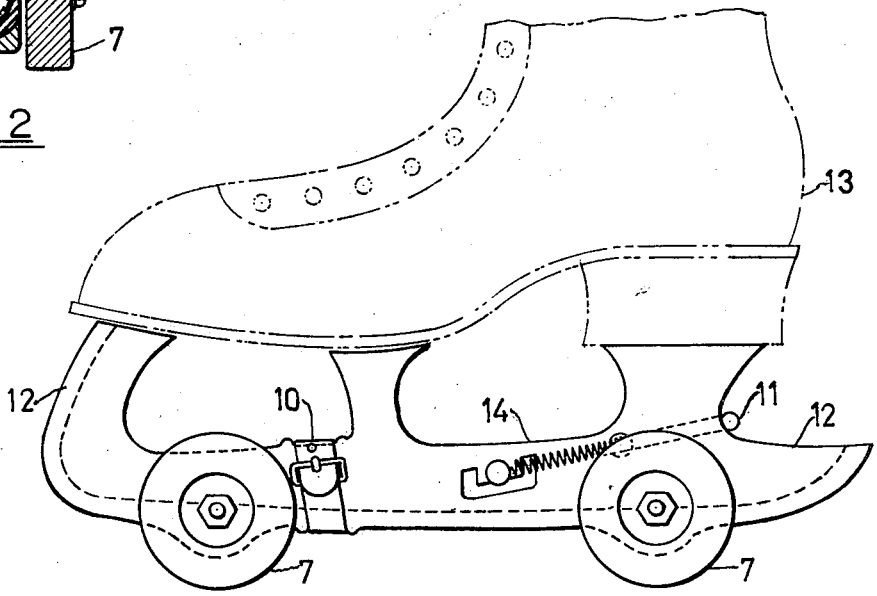
Figure 4:
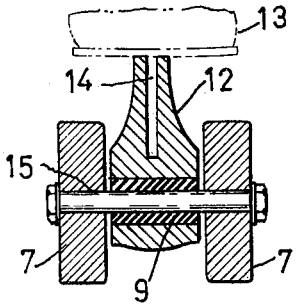
Figure 5:
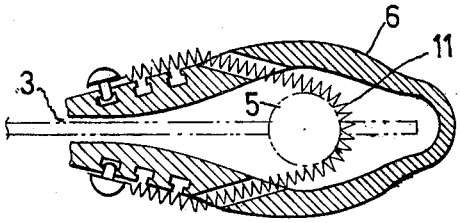

In describing the invention reference will be made to the attached drawings in which, FIG. 1, is a side view of the invention located on a hockey type boot-attached ice skate, FIG. 2, is a section through the view in FIG. 1, FIG. 3, is a side view of the invention located on figure type boot-attached ice skate, FIG. 4, is a section through the view in FIG. 3, and FIG. 5, shows a detail of the rear attachment component of the invention.

In the drawings, FIG. 1 shows a typical hockey type ice skate 1, which is attached to a boot 2. The skate 1 usually consists of a metal blade 3 which is firmly fixed to a tubular frame 4. The frame 4 is attached to the sole of the boot by upright tubular supports 5 which are somewhat conical in shape.

The invention consists of a casing 6 which generally encloses the blade 3, covering its front and rear, except the supports 5, as shown in FIG. 2. The casing 6 is provided with two pairs of the usual roller skate wheels 7,7, which rotate upon a shaft 8 which is embedded in rubber 9, to provide a small amount of flexibility, thereby considerably reducing shock and spills.

The casing 6 which is preferably made of a light weight but strong material is firmly attached to the skate by a buckle equipped belt 10 which goes around the casing 16 and the blade 3, at about the center of the casing. The rear of the casing is also held to the rear of the skate by means of a spring or an elasticized band 11 which is attached in tension to one wall of the said casing, goes around the rear of the skate 1, and hooks onto the outside of the other wall, so that it can be released when the casing is to be removed, as shown in the sectional view in FIG. 5.

In FIG. 3 the casing 12, is similar to the casing 6, however, it varies from the casing 6, in that it is adapted to fit the figure skate blade 14 attached to boot 13. The casing 12 is provided with the usual two pairs of roller skates 7,7, which rotate on a shaft 15, which is embedded in rubber or similar material 9.

In use, these converters have been proven to be very effective, and quite often preferred to the independent type of roller skate; and because the invention covers the front as well as the rear of the skate blade, it also serves as a stop which is usually provided only in very expensive skating boots.

Having described our invention what we claim is,

1. A device for converting boot-attached ice skates to roller skates, which consists of a casing which is used in connection with figure type of boot-attached ice skates, in which the blade supports which attach the said blade to the heel and sole of the boot are integral extensions of the blade, the said casing extending upwardly to cover the exterior of such extensions, including the entire skate blade; in combination with a pair of regulation roller skate wheels attached to the front and rear of said casing, said wheels rotating on shafts which pass through and are supported by said casing, and said shafts being embedded in rubber or any other resilient material, for the purpose of reducing shock and spills; a buckle equipped belt by means of which the casing is attached to the skate, located near the center of the casing; and a spring or elasticized band, located in the rear of the casing, wrapped around the rear blade to boot heel support, and removably attached to each side of the casing, in tension.

* * * * *